United States Patent [19]

Birkle et al.

[11] 4,427,522

[45] Jan. 24, 1984

[54] ELECTRICALLY INSULATING PROTECTIVE DEVICE

[75] Inventors: Siegfried Birkle, Höchstadt; Klaus Stöger, Nuremberg; Johann Gehring, Spardorf, all of Fed. Rep. of Germany; Hans De Vries, NG Heerde, Netherlands

[73] Assignee: Siemens Aktiengesellschaft, Berlin and Munich, Fed. Rep. of Germany

[21] Appl. No.: 361,395

[22] Filed: Mar. 24, 1982

[30] Foreign Application Priority Data

Mar. 25, 1981 [DE] Fed. Rep. of Germany ..... 3111786

[51] Int. Cl.[3] ..... C25D 17/02; C25D 17/06; C25D 17/08

[52] U.S. Cl. ..... 204/279; 204/196; 204/228; 204/DIG. 7; 204/287

[58] Field of Search ..... 204/196, 228, 279, 287, 204/DIG. 7, 243 R

[56] References Cited

U.S. PATENT DOCUMENTS

| | | | |
|---|---|---|---|
| 3,023,154 | 2/1962 | Hough et al. | 204/DIG. 7 |
| 3,679,568 | 7/1972 | Westerlund | 204/279 |
| 3,962,066 | 6/1976 | Barber et al. | 204/279 |
| 4,053,383 | 10/1977 | Dötzer et al. . | |
| 4,176,034 | 11/1979 | Stoger et al. . | |

*Primary Examiner*—T. Tung
*Assistant Examiner*—Nathan S. Thane
*Attorney, Agent, or Firm*—Kenyon & Kenyon

[57] ABSTRACT

In a tank of aluminizing electroplating cells which may contain racks for articles, operated with aprotic oxygen-free and water-free organo-aluminum electrolytes, a lining of individual segments coated with resistant materials (enamel or electrolyte-resistant plastics) is provided as an electrically insulating protective device. The outer edges of the side baffles, coated all around, are bent round toward the outside and are held together by connecting straps which are bent round toward the inside. The individual bottom segments coated all around lie on top of each other overlapping in roof tile fashion. The protective device may also include a similarly insulated band arranged all around the cell.

10 Claims, 5 Drawing Figures

ELECTRICALLY INSULATING PROTECTIVE DEVICE

BACKGROUND OF THE INVENTION

This invention relates to aluminizing electroplating cells, which may contain racks for articles, operated with aprotic, oxygen-free and water-free organo-alumino electrolytes in general and more particularly to an electrically insulating protective device for such cells.

It is known that in electroplating facilties when the electroplating voltage is applied between the cathode and the anode, the electrolyte tank must be electrically insulated because of the current conducting property of the electrolytes and the prevailing electric field, because otherwise the electrolyte, as well as the electroplating tank, can suffer damage due to the stray-imparting conduction effect of the electroplating tank if an electrolyte tank of metal is used.

In the customary electroplating technology using an aqueous electrolyte system, the electroplating tanks are therefore made of a suitable plastic material, or if metal is used, the inside surface is rubber coated.

However, this possibility of insulating the electrolyte tank is not applicable from aluminizing electroplating cells operated with aprotic, oxygen-free and water-free organo-aluminum electrolytes. Electrolyte tanks insulated in this manner are also not suited for electroplating facilities such as are described in U.S. Pat. Nos. 4,053,383 and 4,176,934. These organic electrolyte solutions, which are used at about 100° C., over the long term destroy the plastic tanks, or metal tanks with plastic lining, which are customary in electroplating.

In the two aforementioned patents, for example, in FIG. 2 of U.S. Pat. No. 4,053,383, an annular treatment tank is illustrated. Thus, the annular tank includes an inner wall and an outer wall. Adjacent the inner and outer walls and are inner and outer anode segments which form the anode for electroplating. The workpiece holder is disposed between the two anodes and the workpiece forms the cathode.

The electric insulation of the electrolyte tank with respect to an aprotic medium could be solved by providing the inside wall of the tank with an enamel coating (see U.S. Pat. No. 4,053,383). Since enamel is an inorganic material, it is completely resistant. The enamelling process, however, has the disadvantage that larger electrolyte tanks with a volume of several thousand liters can no longer be coated, or coated only at a major expense.

It is an object of the present invention to make metallic electrolyte tanks, especially with large dimensions, more suitable for the electrodeposition of aluminum from aprotic, oxygen-free and water-free organo-aluminum electrolyte systems. The objective is to solve the problem of electric insulation with respect to an aprotic electrolyte system where a metallic electrolyte tank is used.

SUMMARY OF THE INVENTION

This problem is solved in an electroplating aluminizing cell by using a lining according to the present invention, of individual sheet metal segments which are coated with resistant materials and are optionally bent, i.e., curved and which:

(a) are arranged behind the anodes at the walls of the electrolyte tank as side baffles, the vertical outer edges of which are bent round toward the outside and are held together by connecting straps, and (b) loose bottom segments on the bottom surfaces of the electrolyte tank which partially lie on top of each other overlapping in roof tile fashion.

The lining of individual segments according to the present invention is electrically strong and prevents fault currents. The advantage over complete enamelling of the inner vessel walls is in particular that the method according to the present invention can technically be realized even for larger electroplating cells.

It is also less expensive because no large firing furnaces and over-size sheet metal wall thicknesses are necessary.

The lining of the electrolyte tank walls with the individual side baffles can have a spacing of about 10 mm. The segments can also be arranged with the same spacing from the tank bottom.

Suitable resistant materials are enamel or electrolyte resistant plastics. These include, in particular, those of the polyimide, epoxy, phenol- and aminoplasts, polyvinylidene fluorides and polyphenylene sulfide type.

The vertical outer edges of the clamp-like connecting straps which are enamelled all around or coated with plastic are each bent off round toward the inside. The individual segments which are arranged loosely on the bottom surface preferably lie on top of each other overlapping approximately 3 cm. For firmly securing the individual side baffles, sheet metal beads may be formed into the bottom metal sheets.

In a further preferred embodiment of the present invention, a band which is arranged all around the cell and is a similarly insulated, a supplementary sheet metal strip, is provided in order to achieve still better electrical shielding. At the same time, the band also closes any gaps which still exist.

The article racks may also be enamelled or coated with electrolyte resistant plastics. The particularly suitable plastics have already been mentioned above.

DETAILED DESCRIPTION

Figure 1:
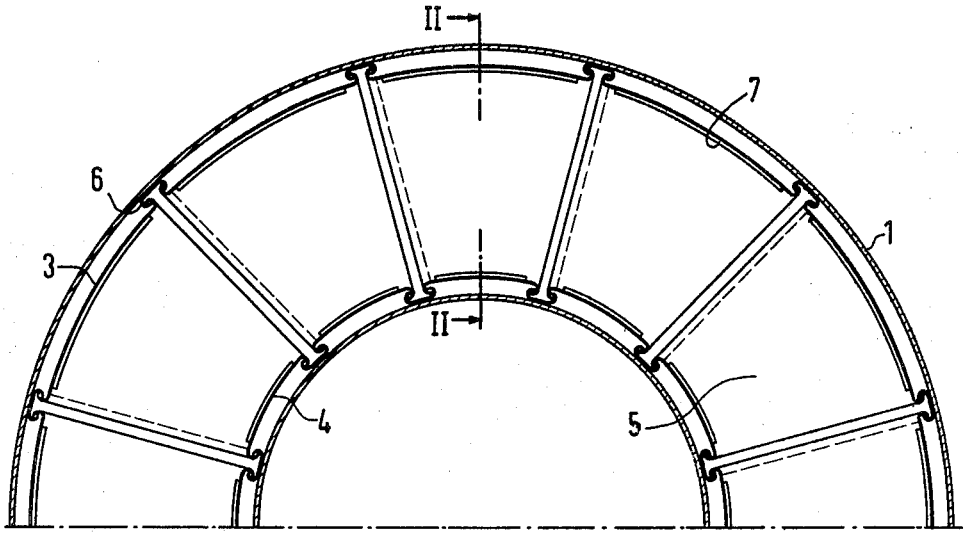
FIG. 1 shows a top view onto a ring cell according to the present invention.
Figure 2:
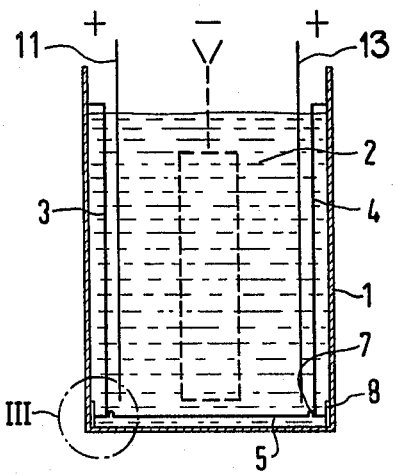
FIG. 2 is a cross section II—II of FIG. 1.
Figure 3:
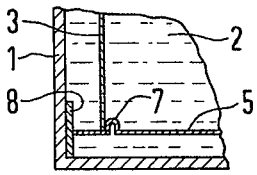
FIG. 3 is a detail III—III of FIG. 2.
Figure 4:
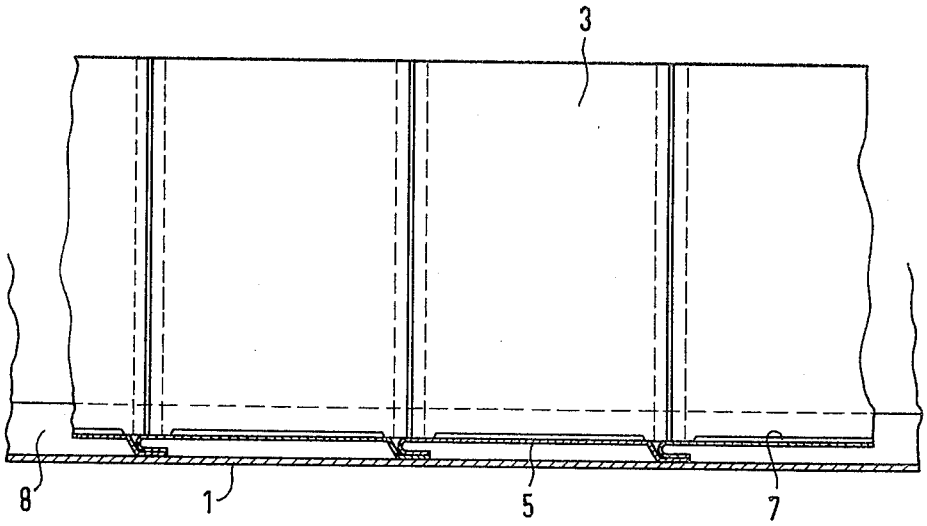
FIG. 4 is a development of FIG. 1.
Figure 5:
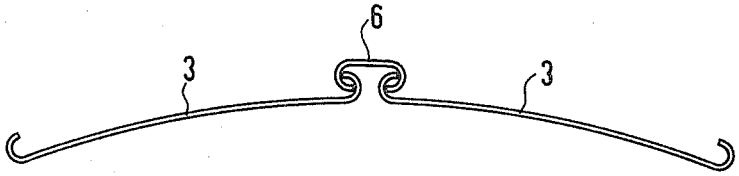
FIG. 5 is a top view of an enlargement of the connecting strap (connecting clamp).

The electroplating cell of the device shown consists of a circular electrolyte tank 1 of rotationally symmetrical design which can be heated. It contains an aprotic, oxygen-free and water-free organo-aluminum electrolyte 2. The side wall and the bottom of the tank are lined with segments of sheet metal which are enamelled all around. For this purpose, the individual side baffles are pre-bent to match the curvature of the tank and their vertical edges bent round toward the outside in accordance with FIG. 5. The spacing of the outer side baffles 3, of the inner side baffles 4 and the bottom baffles 5 from the tank wall or the tank bottom is in each case 10 mm. As illustrated in FIG. 2, the baffles 3 and 4 are between the anodes 11 and 13 and the walls of tank 1. In other words, the baffles are arranged behind the anodes. Also shown in FIG. 2 in dotted lines is the location of the workpiece forming the cathode. The individual bottom metal sheets 5 overlap by about 3 cm. The clamp-like connecting straps 6 which are enamelled are around and are bent in accordance with FIG. 5 ensure a good connection of the individual side baffle segments 3 and 4. For firmly securing the individual side baffle segments 4, sheet metal beads 7 are formed at the bottom metal sheets 5. The side baffles are thereby prevented from giving toward the inside. An additional sheet metal strip 8 closes gaps that may still exist and assures complete electrical shielding.

What I claim is:

1. An electrically insulating protecting device for use in aluminizing electroplating cells, having an electrolyte tank and which may contain racks for articles which are coupled to a cathode terminal, and anodes located adjacent to the sides of the tank, between which anodes the articles may be disposed, operated with aprotic, oxygen-free and water-free organo-aluminum electrolytes, comprising a lining of individual sheet metal segments which are coated with resistant materials and which include:

(a) side baffles disposed behind the anodes at the walls of the electrolyte tank, the outer vertical edges of said side baffles being bent round toward the outside;

(b) connecting straps holding said side baffles together; and (c) loose bottom segments on the bottom surfaces of the electrolyte tank, said bottom segments lying on top of each other partially overlapping in roof tile fashion.

2. An electrically insulating protective device according to claim 1, wherein the individual side baffles and loose bottom segments are arranged at a distance of about 10 mm from the outer wall and the bottom of the tank, respectively.

3. An electrically insulating protective device according to claim 2, wherein said sheet metal segments are enamelled on all sides with a coating about 1 mm thick.

4. An electrically insulating protective device according to claim 2, wherein said sheet metal segments are coated all around with a coating about 1 mm thick with an electrolyte resistant plastic.

5. An electrically insulating protective device according to claim 2, wherein the vertical outer edges of said connecting straps are each bent-off round toward the inside.

6. An electrically insulating protective device according to claim 1, wherein the individual segments loosely arranged on the bottom surface lie on top of each other overlapping about 3 cm.

7. An electrically insulating protective device according to claim 6, and further including sheet metal beads formed into the individual bottom segments.

8. An electrically insulating protective device according to claim 1 and further including an insulated band arranged all around the cell.

9. An electrically insulating protective device according to claim 1 and further including an enamelled article rack.

10. An electrically insulating protective device according to claim 1 and further including an article rack coated with an electrolyte resistant plastic.

* * * * *